United States Patent [19]

Wincent

[11] 4,415,287

[45] Nov. 15, 1983

[54] PRINTING DEVICE FOR PRINTING CHARACTERS IN ROWS ON DATA CARRIERS

[75] Inventor: Tommy Wincent, Tiverton, R.I.

[73] Assignee: Westrex Company, Asia, Fall River, Mass.

[21] Appl. No.: 245,812

[22] Filed: Mar. 20, 1981

[30] Foreign Application Priority Data

Mar. 24, 1980 [SE] Sweden ..... 80022494

[51] Int. Cl.[3] ..... B41J 19/00

[52] U.S. Cl. ..... 400/322; 400/328; 400/584; 400/588

[58] Field of Search ..... 400/320, 322, 323, 328, 400/584, 586, 588

[56] References Cited

U.S. PATENT DOCUMENTS

| | | | |
|---|---|---|---|
| 3,882,988 | 5/1975 | Sloan et al. | 400/321 |
| 3,902,418 | 9/1973 | Moroshita et al. | 400/586 X |
| 4,027,765 | 6/1977 | Crump et al. | 400/584 |
| 4,167,345 | 9/1979 | Englund et al. | 400/588 |
| 4,179,223 | 12/1979 | Kwan et al. | 400/323 X |
| 4,180,335 | 12/1979 | Yamada | 400/322 X |
| 4,181,443 | 1/1980 | Hirabayashi et al. | 400/320 |
| 4,311,399 | 1/1982 | Wegryn et al. | 400/323 X |
| 4,313,684 | 2/1982 | Tazaki et al. | 400/322 |

*Primary Examiner*—Edward M. Coven

*Attorney, Agent, or Firm*—Robert F. Rotella; Michael H. Wallach

[57] ABSTRACT

A printing device comprises a print head and a plurality of data carriers, the print head being able to print data on at least one of the plurality of data carriers; a motor for moving said print head along said data carriers; said print head being adapted to rest at one of a plurality of home positions when said print head is not in movement; said motor being reversible to change the direction of movement of said print head; a switch coupled to and controlled by said motor; said switch being controlled by said motor to assume a plurality of states, each of said states corresponding to the location the said print head at a particular one of said print head home positions; and a printing control unit for selecting which of said data carriers is to receive data printed thereon by said print head; said printing control unit being electrically coupled to said switch and to said motor; said printing control unit also acting in response to the state of said switch to select the direction of movement of said motor means and, consequently, that of said print head as well as the printing of data by said print head; whereby, said print head is moved from a previous home position to the particular one or more of said plurality of data carriers which are to receive data to be printed thereon by said print head thereby bypassing any intervening data carriers on which data is not intended to be printed thereon during a given cycle of said printing device, said motor coming to rest under control of said control unit at the conclusion of each cycle.

1 Claim, 2 Drawing Figures

PRINTING DEVICE FOR PRINTING CHARACTERS IN ROWS ON DATA CARRIERS

DESCRIPTION

1. Technical Field

The present invention relates to a method of printing characters in rows on at least two data carriers situated side by side in a printing device, and a printing device for carrying out the method.

2. Background Art

It is known to print characters in rows on two or more data carriers situated side by side in a printing device which comprises a single printing head driven by a reversible motor for reciprocating travel between a home position to the right of the right-hand data carrier and a home position to the left of the left-hand data carrier. The printing head is given impulses from a data processing means connected thereto, and can print characters on the data carriers during its movement forwards as well as backwards between the home positions. In the case where characters are only to be printed on one of the data carriers, the printing head must be moved backwards and forwards between both its home positions along the whole distance between both data carriers, resulting in that the printing head is idling during a large part of its travel, which reduces printing speed and increases wear on the details included in the printing device.

If the data processing means comprises an electronic cash register and the data carriers comprise receipt strip and audit or journal strip, then in most cases it will be found that the receipt strip is printed during nearly every operation cycle, while the journal strip is printed much less often. It has therefore been proposed to break off the travel of the printing head in the printing direction and return it to its home position to the right of the receipt strip after completed printing of the receipt strip by itself, or after printing both receipt strip and journal strip. If the receipt strip by itself is to be printed, the printing head thus changes direction between the strips and is not moved over the journal strip, it thus being prevented that the head goes "idle" over the journal strip, which saves time. The drawback with this proposal is, however, that the printing head can provide either the receipt strip or the receipt strip and journal strip with printed characters only during its travel in one direction, which naturally reduces the printing speed considerably.

DISCLOSURE OF INVENTION

The object of the present invention is to provide a method and device resulting in that the printing speed can be increased considerably and that the travel of the printing head during each operation cycle will be as short as possible.

This object is achieved by the invention being given the characterizing features disclosed in the claims.

PREFERRED EMBODIMENT

Figure 1:
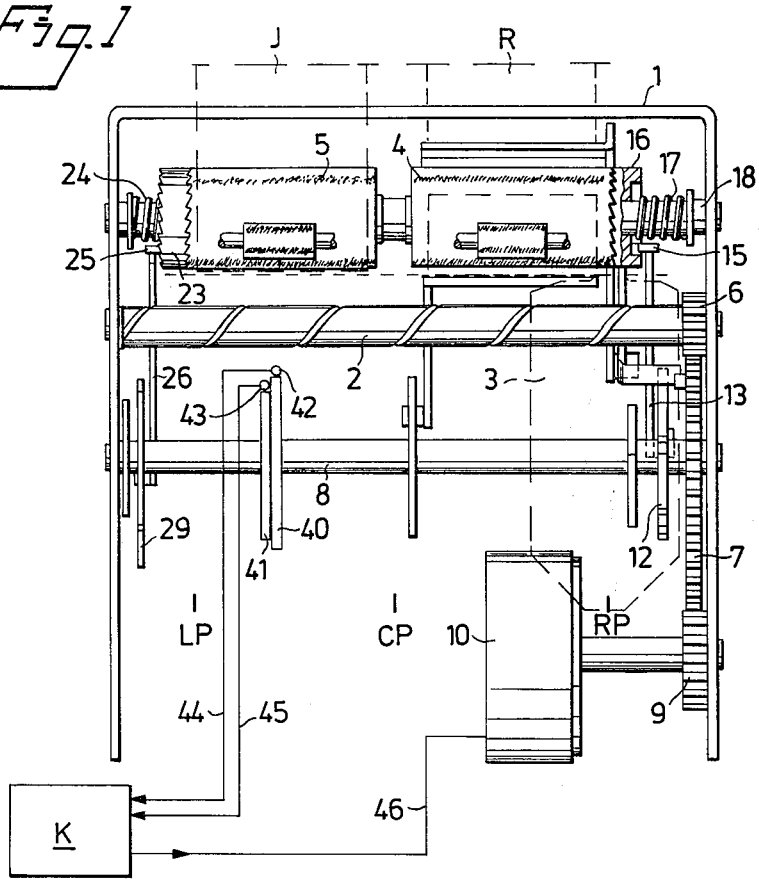
FIG. 1 is a view seen from the front of a printing device in accordance with the invention connected to a schematically indicated electronic cash register.

In FIG. 1 there is shown a printing device in accordance with the invention, which is with few exceptions identical with the printing device illustrated in the U.S. Pat. No. 4,167,345. Since the device is exhaustively described and shown in this specification, only its general construction and the details which have immediate association with the present invention will be described below.

In FIG. 1, the numeral 1 denotes the frame to which all the components of the printing device are attached. A worm shaft 2 rotatably mounted in the frame 1 drives a mosaic printing head 3 reciprocatingly along two plattens 4 and 5. The shaft 2 is driven via gears 6, 7 and 9 by a reversing electric motor 10. A shaft 8, rotatably mounted in the frame 1, is driven by the gear 7, which is rigidly connected to the shaft. The shaft 8 is provided with several cams for controlling different functions in the printing device when the shaft rotates. One of the cams, namely the one denoted by 12, controls the row advance of the data carrier lying against the platten 4 and constituting a receipt strip R. Via a cam follower 13, a pin 15, a ratchet wheel 16 and a spring 17, the cam 12 actuates the platten 4, rotatably mounted on a shaft 18, at given times to turn it a short distance and thereby advance the strip R upwards a row in FIG. 1.

Another cam 29 controls the row advance of the data carrier lying against the platten 5 and constituting a journals strip J. Via a cam follower 26, a pin 25, a ratchet wheel 23 and a spring 24 the cam 29 actuates the platten 5, rotatably mounted on the shaft 18, at given times to turn it a short distance and thereby advance the strip J upwards one row in FIG. 1.

Figure 2:
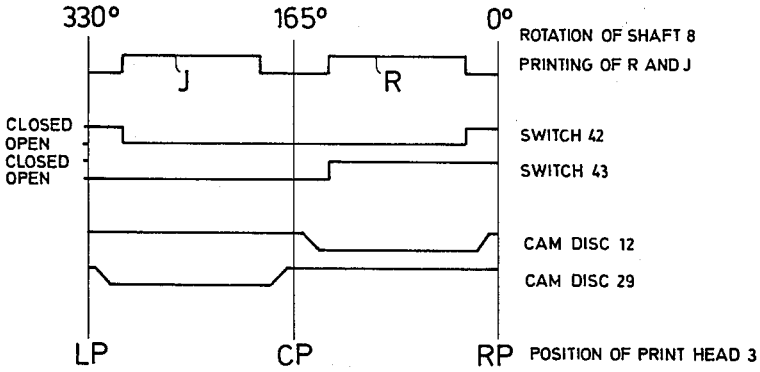
FIG. 2 is a timing diagram showing the sequence for certain details incorporated in the printing device during an operation cycle.

It will be seen from FIG. 2 at what times the cams 12 and 29 actuate the receipt strip R and journal strip J. When the shaft 8, and thereby the cam 12, has been turned about 10° from its end position, wherein the printing head is in its home position RP to the right in FIG. 1, the cam 12 actuates the cam follower 13, which carries out a collecting motion, i.e. prepares the advancing mechanism 15, 16, 17, 4 for advance. At about 155°, the cam 12 once again actuates the cam follower 13, but in the opposite direction, the platen 4 being turned a short distance and the strip R advanced upwards a distance corresponding to the pitch between two rows thereon. When the printing head is in its home position CP in FIG. 1, i.e. in a position between the strips R and J, and is moved to the right, the collecting movement of the advancing mechanism 15, 16, 17, 4 takes place at the same time as the advance just described took place, i.e., at 155° from the home position RP, and the row advance of the strip R takes place at the same time as the collecting movement just described, i.e. at about 10°. One and the same time, i.e. the cam 12, thus carries out row advance of the strip R immediately after the printing head 3 has passed over it, irrespective of whether the printing head is in the home position RP or CP at the beginning of the movement.

Row advance of the journal strip J takes place in a similar way as has been described in conjunction with the receipt strip R, but with the difference that the collecting movement of the advancing mechanism 23–25, 5 takes place when the cam 29 has been turned about 175° from its end position at 0° turn of the shaft 8, at which the printing head 3 is in its home position RP, and its travelling movement takes place when the cam has been turned about 320° from this end position. Since the printing head assumes its home position CP when the cam 29 has been turned about 165°, it will be understood that the collecting and advancing movements of the advancing mechanism 23–25, 5 take place at a time after this home position has been passed, no journal strip advance ever taking place during the printing head travel between home positions RP and CP.

Row advance of the journal strip J also takes place when the printing head 3 is moved to the right from its left-hand home position LP, over the journal strip, when the collecting movement of the advancing mechanism 23–25, 5 takes place shortly after the direction of rotation of the cam 29 has been reversed (which takes place at the home position LP of the printing head 3) and its advancing movement takes place immediately after the printing head has passed over the journal strip, i.e. at a turn of about 175° of the shaft 8. The collecting movement of the advancing mechanism 23–25, 5 initiated by the cam 29 at the movement of the printing head 3 towards the left over the journal strip J is thus corresponded to by an advancing movement of the advancing device when the printing head is moved to the right and passes over the journal strip, and the advancing movement of the advancing mechanism when the printing head is moved to the left is corresponded to by a collecting movement when the printing head is moved to the right.

The turn from the end position of the shaft 8, and thereby the turn of cams 12 and 29, at which the printing head 3 assumes the position RP, is maximally 330°, which will be seen from FIG. 2. The travel of the printing head 3 between the home positions RP and LP is thus corresponded to by a turn of the shaft 8 of 330°, while its travel between the home positions RP and CP as well as LP and CP are corresponded to by a shaft turn of about 165°.

As mentioned above, the printing head 3 can assume three home positions RP, CP and LP, and can remain in anyone of these positions after a completed operational cycle. An operational cycle is defined in this connection as the time during which the printing head travels between two of its home positions irrespective of the distance between them and the direction of motion of the printing head. During an operational cycle, the head can thus be optionally moved solely over one of the strips R and J or over both strips, and can print characters on either of the strips or on both strips, not only in one direction of the printing head travel, but in the other direction as well. During several sequential operational cycles, it is thus possible for repeatedly printing characters on the receipt strip R by itself, during the printing head travel to the right as well as to the left betweem the home positions RP and CP, the strip R being advanced a row between each printing sequence by the advancing mechanisms 15–17 and 4, or on both strips R and J during printing head travel to the right as well as to the left home positions RP and LP, both strips being advanced by said advancing mechanisms 15–17, 4 and 23–25, 5.

Circuits in the electronic cash register K activate the printing head 3 to print certain characters when it passes over the strips R and/or J, as well as giving signals to the motor 10 for starting it in one or other of its directions of rotation when the printing head is in one of its three home positions RP, CP or LP and is to begin operation, and for stopping the motor when the printing head assumes or approaches one of its home positions and is no longer to be in operation. For signalling to the cash register circuits what positions the head 3 is in, which is necessary, e.g. for these circuits to initiate starting the motor in the right direction of rotation and for stopping the motor at the right time and for initiating printing of characters during the movement of the printing head, two cams 40 and 41 have been attached side by side to the shaft 8, for actuating two switches 42 and 43 connected by wires 44 and 45 to two of said circuits. Since the angular positions of the shaft 8 and thereby the cams 40 and 41 always correspond to a given definite position of the printing head 3 relative the strips R and J, the switches thus supply information to the cash register circuits as to the position of the printing head.

FIG. 2 schematically illustrates the operational mode of the switches 42 and 43. For the right-hand home position RP of the printing head 3 neither of the switches is actuated by the cams 40 and 41, and they are therefore both closed. After the motor 10 has been started and begins to rotate forwards, having been given the impulse to do so from the cash register circuits by the wire 46 (both switches 42 and 43 being closed signifies that the printing head 3 is in the position RP and must be moved to the left from this position), the cam 40 actuates the switch 42 so that it is opened (at a turn of about 20° of the shaft 8) which gives a signal to the cash register circuits that the printing head 3 can begin to print on the strip R. If only one row on the strip R is to be printed, the head stops in the home position CP between the strips (at a turn of about 165° of the shaft 8), it being given a signal to do so, via the motor 10, from the cash register circuits after the switch 43, at a turn of about 145° of the shaft 8, has opened and signalled information to said circuits that the printing head is approaching its home position CP. If a further row is to be printed on the strip R, said circuits give a signal to the motor 10 to reverse and drive the printing head to the right for printing a row on the strip R during this travel (both switches 42 and 43 being open signifies that the printing head is in the position CP and can be moved in either direction from this position). At the termination of printing head travel to the right, the switch 42 closes, thus giving a signal to the cash register K that printing is to cease and that the motor is to be stopped at the printing head home position RP, or turn in this position and print a further row on the strip R.

If rows on both receipt strip R and strip J are to be printed during travel of the printing head 3 from the home position RP, the head continues to move to the left after a row has been printed on the strip R in the way described above, and thereafter prints a row on the strip J also. At the end of the printing head travel to the left over the strip J, the cam 40 actuates the switch 42 so that the latter closes, thus causing printing to cease. At the left-hand position of the printing head, the closed contact 42 and the open contact 43 indicate that the head is in its home position LP, and thus the motor must be rotated backwards during a subsequent operational cycle, and the printing head moved to the left in FIG.1.

If, from the position LP the printing head is to print a row on the journal strip J and a row on the receipt strip R, the head is moved to the right in FIG. 1 and prints characters in a row first on the strip J and thereafter in a row on the strip R. After a turn of about 20° of the shaft 8, the switch 42 is actuated whereby printing is commenced, after a turn of about 185° (i.e. 145° from the position RP) the switch 43 is actuated and after a 310° turn the switch 42 is actuated again, whereby printing is terminated.

Even if the above related examples are only some of the number possible, it should have been clear that the switches 42 and 43 to the cash register circuits give signals which unambiguously indicate which home position RP, CP or LP the printing head is in, and when printing of the strips R and J can be commenced or must be terminated. In the position RP, the switches 42 and 43 are closed, in the position CP the switches are open and in the position LP the switch 42 is closed while switch 43 is open. It is therefore possible for these circuits to stop the motor 10 or start it in the desired direction of rotation in any one of the three home positions of the printing head.

Even if only one embodiment of the invention has been described above and shown on the drawings, it should be understood that this can be modified, or that other embodiments are possible without departing from the inventive concept. Thus it is possible to allow the cams 40 and 41 to actuate the switches 42 and 43 at other times than those described, when the printing head 3 is moved to, or away from its home positions. It is also possible to combine the cams 40 and 41 to a single cam with two different paths for the switches 42 and 43.

The invention is thus only restricted by what is stated in the claims.

I claim:

1. A printing device comprising print head means and a plurality of data carriers:

said print head means for printing data on at least one of said plurality of data carriers;

motor means for moving said print head means along said data carriers;

said print head means being adapted to rest at one of a plurality of home positions when said print head means is not in movement;

said motor means being reversible to change the direction of movement of said print head means;

switch means coupled to and controllable by said motor means;

said switch means being controlled by said motor means to assume a plurality of states, each of said states corresponding to the location of said print head means at a particular one of said plurality of print head home positions; and printing control means for selecting which of said plurality of data carriers is to receive data printed thereon by said print head;

said printing control means being electrically coupled to said switch means and to said motor means;

said printing control means also acting in response to the state of said switch means to select the direction of movement of said motor means and, consequently, that of said print head means as well as the printing of data by said print head means; whereby, said print head means is moved from a previous home position to the particular one or more of said plurality of data carriers which are to receive data to be printed thereon by said print head means thereby bypassing any intervening data carriers on which data is not intended to be printed thereon during a given cycle of said printing device, said motor coming to rest under control of said printing control means at the conclusion of each cycle.

* * * * *

UNITED STATES PATENT AND TRADEMARK OFFICE

CERTIFICATE OF CORRECTION

PATENT NO. : 4,415,287

DATED : November 15, 1983

INVENTOR(S) : Tommy Wincent

It is certified that error appears in the above—identified patent and that said Letters Patent is hereby corrected as shown below:

Column 2, line 55, change "time" to --cam--

Column 3, line 57, insert --between-- after "left"

Signed and Sealed this

*Thirty-first* Day of *January 1984*

[SEAL]

*Attest:*

GERALD J. MOSSINGHOFF

*Attesting Officer*

*Commissioner of Patents and Trademarks*